United States Patent [19]

Hurst et al.

[11] 4,321,742

[45] Mar. 30, 1982

[54] METHOD OF PRODUCING CURVED WEAR LINING

[75] Inventors: George P. Hurst, Jackson, Calif.; Assar N. Svensson, Ersmark, Sweden

[73] Assignee: Skega Aktiebolag, Ersmark, Sweden

[21] Appl. No.: 168,448

[22] Filed: Jul. 10, 1980

Related U.S. Application Data

[62] Division of Ser. No. 48,596, Jun. 14, 1979, Pat. No. 4,234,291.

[30] Foreign Application Priority Data

Jun. 16, 1978 [SE] Sweden ..... 7806952

[51] Int. Cl.[3] ..... B23P 9/00

[52] U.S. Cl. ..... 29/445; 29/156.4 WL; 29/469.5; 156/221

[58] Field of Search ..... 29/156.4 R, 156.4 WL, 29/445, 469.5; 415/174, 170 R; 156/169, 245, 313, 221

[56] References Cited

U.S. PATENT DOCUMENTS

| | | | |
|---|---|---|---|
| 3,025,206 | 3/1962 | Scholl | 29/445 UX |
| 3,028,667 | 4/1962 | Wintermute et al. | 29/469.5 |
| 3,472,730 | 10/1969 | Frigstad | 156/313 X |
| 3,711,934 | 1/1973 | Zorowski et al. | 29/445 |
| 3,732,028 | 5/1973 | Heynemanns et al. | 415/197 |
| 3,915,781 | 10/1975 | Novak et al. | 156/245 |
| 3,961,104 | 6/1976 | Tanner | 29/156.4 WL X |
| 3,966,523 | 6/1976 | Jakobsen et al. | 156/169 |
| 4,113,407 | 9/1978 | Grzina | 415/170 R |
| 4,120,605 | 10/1978 | Hurst | 415/170 R |
| 4,227,703 | 10/1980 | Stalker et al. | 415/174 X |

*Primary Examiner*—Charlie T. Moon

*Attorney, Agent, or Firm*—Cushman, Darby & Cushman

[57] ABSTRACT

This invention relates to a wear lining containing rubber e.g. for pumps intended for handling wearing material such as dredger and mud pumps of the centrifugal type, which wear lining comprises a layer of wear rubber rigidly combined with a support plate. One of the problems with wear linings of such pumps is that already in manufacture they must be given a shape corresponding to the shape of the shell of the pump housing in which they are to be mounted, and must be manufactured in sections to permit mounting in their pump housing. For this a great number of moulds is required, which involves great costs of manufacture, and as the known wear linings for pumps are manufactured in sections, mounting thereof will be difficult and time-consuming, at the same time as there will be a joint between two sections, which has turned out to be a part of the wear lining that is exposed to wear. To avoid these problems a wear lining of rubber containing means included in the layer of wear rubber of the lining and increasing the resistance of the wear lining to wear is suggested according to the invention, in which these means consist of pins of metal arranged within the layer of wear rubber in one or more reciprocally separated layers and spaced from each other, which pins are oriented in radial planes extending from the center of curvature and at least across the wear surface of the lining, and of compression in the layer of wear rubber increasing from the support plate towards the wear surface, and produced by bending of the wear lining from a substantially plain state to the intended curved shape.

2 Claims, 6 Drawing Figures

METHOD OF PRODUCING CURVED WEAR LINING

Figure 1:
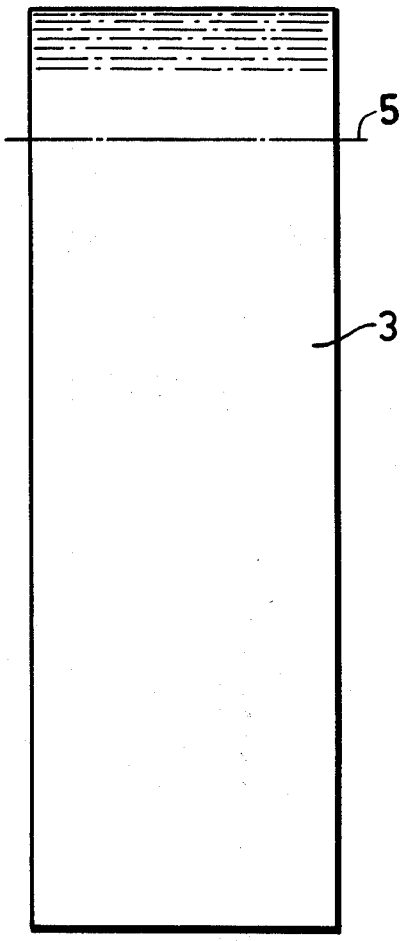

This is a division of application Ser. No. 48,596, filed June 14, 1979, now U.S. Pat. No. 4,234,291 issued Nov. 18, 1980.

This invention relates to a wear lining containing rubber e.g. for pumps intended for handling wearing materials, such as e.g. dredger and mud pumps of centrifugal type, which wear lining comprises a layer of wear rubber rigidly combined with a support plate, as well as a method for the production of such wear linings.

Wear linings of rubber for pumps intended for handling wearing material, e.g. centrifugal pumps for dredging of sand and dredged material and for pumping of such materials have been known for a long time, as well as pump liners of cast iron and steel alloys. It has been found that rubber is the most advantageous material for use in linings for pumps that are substantially intended for pumping of pure sand and similar materials. On the other hand, if the material to be pumped contains sharp stones, broken glass, cans, metal pieces and other sharp and hard particles that may occur in deposits on bottoms of channels, rivers, harbours and in other water, pump liners of cast iron or steel alloys have turned out to be better in view of strength and wear than linings of pure rubber, on account of the fact that rubber is not capable of resisting the cutting effect that such objects may have in motion but is often cut to pieces, the consequence being that big rubber pieces can be easily cut and torn away from the lining. However, it has recently become possible to eliminate this disadvantage with wear linings of rubber by embedding one or more layers in the form of perforated steel plates or steel wire nets in the wear layer consisting of rubber, which has been found to have a position influence on the resistibility of wear linings consisting of rubber to cutting damage and wear.

Either they consist of metal or rubber all these known wear linings for pumps must, however, already in manufacture be given a shape corresponding to the shape of the shell of the pump housing in which they are to be placed, and be made in sections to be mounted in their pump housings. Thus, for the manufacture of these known wear linings a number of moulds is required, i.e. substantially one mould for each section, and as the manufacture of the moulds is difficult and time-consuming as well as expensive it will also be very expensive to make the known wear linings. As they are also manufactured in sections the mounting thereof will be difficult and time-consuming, not the least as each section must be individually secured in the pump housing. Also the joint between two such sections is a part exposed to wear, above all at the wear linings consisting of rubber.

It is the object of this invention to produce a wear lining containing rubber primarily for pumps that need not be made in moulds but can be manufactured in relatively big lengths and then, after possible cutting to an intended length, are shaped to intended shape by bending, e.g. at the place of their use, and which, moreover, shold have at least the same wear hardness and abrasion resistance as the known wear linings consisting of rubber.

This has been achieved by providing the wear lining of the present invention with the characterizing features set forth in the claims.

Figure 2:
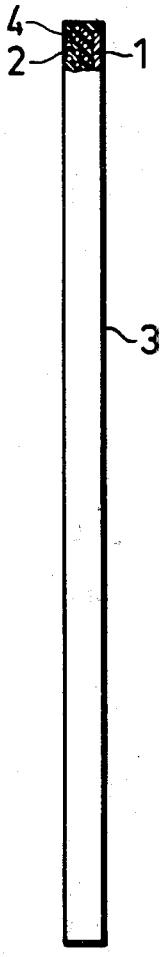
Figure 3:
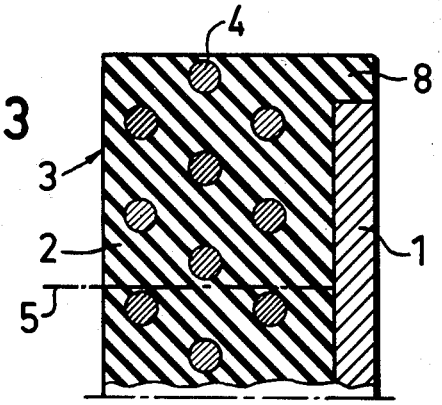
Figure 4:
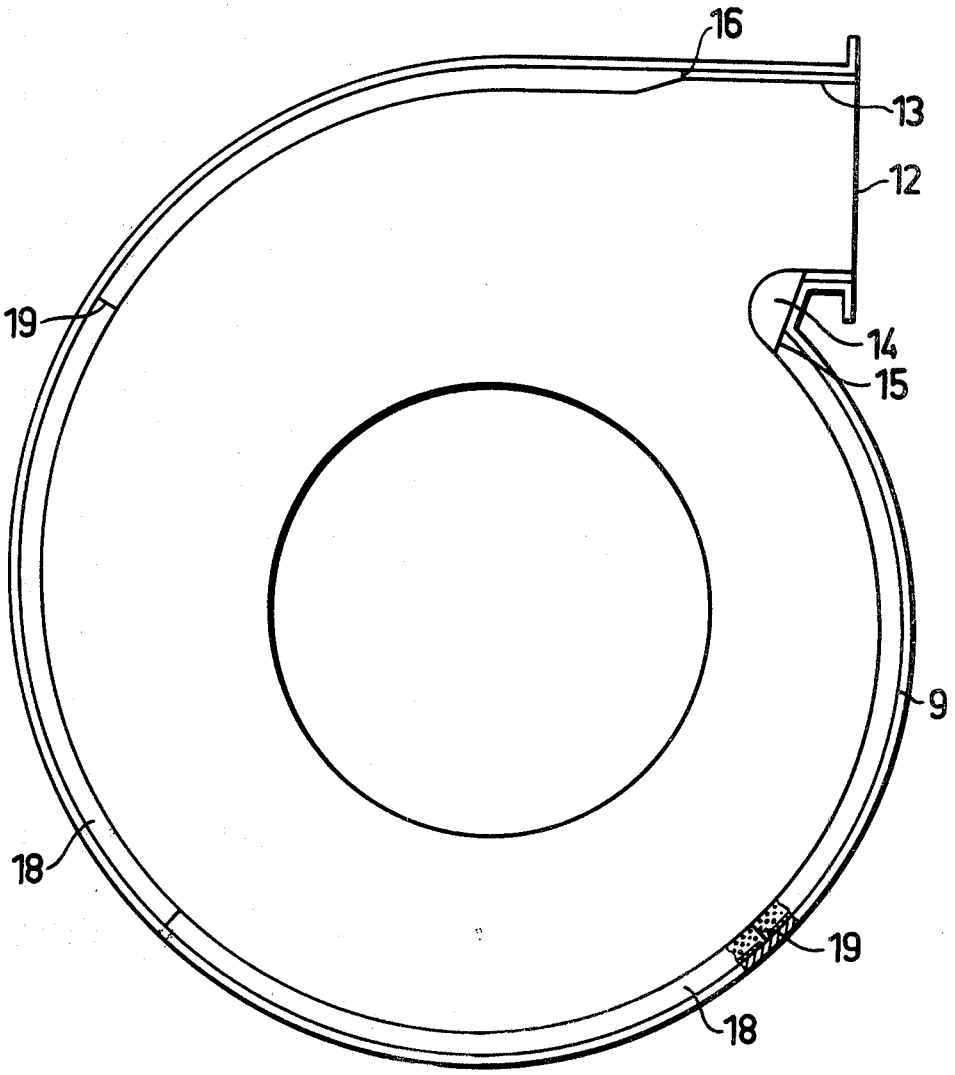
Figure 5:
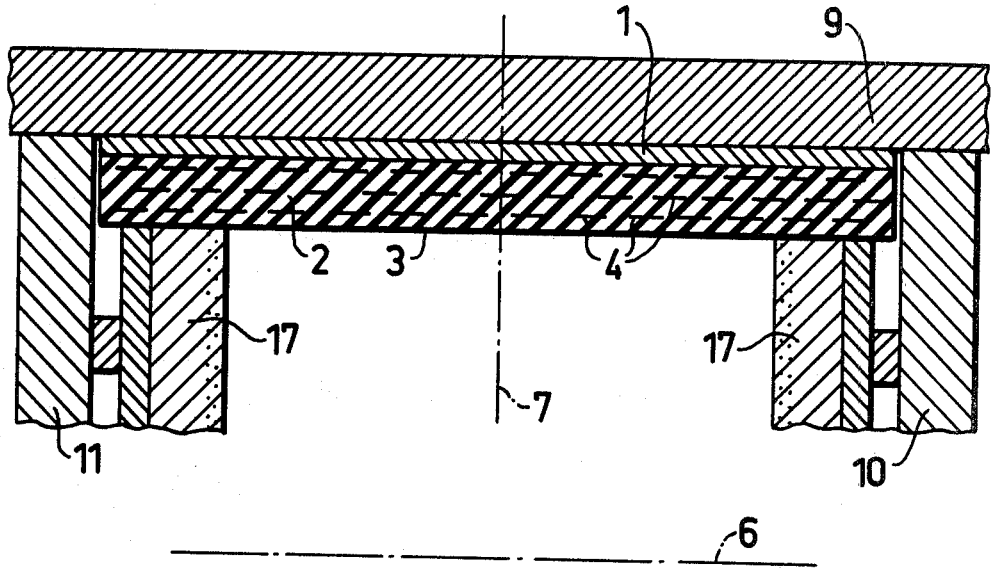
Figure 6:
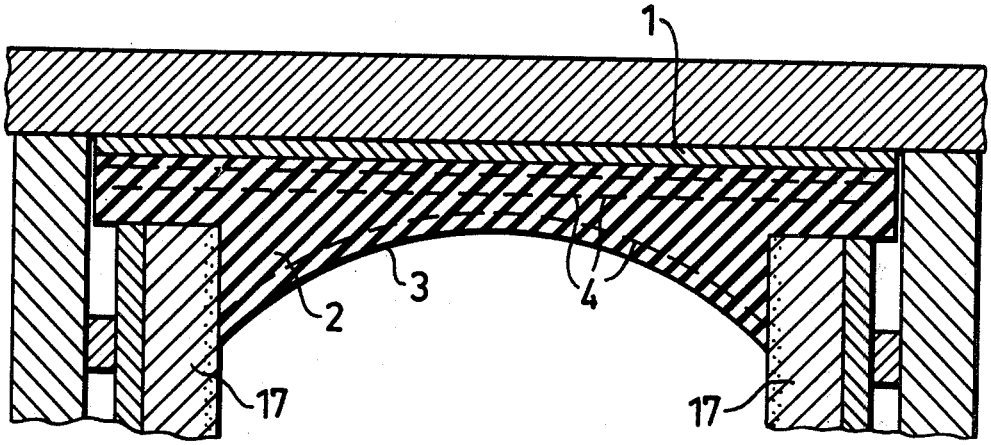

The invention is illustrated more in detail with reference to the enclosed drawings, in which:

FIGS. 1 and 2 are a plan view and a lateral view, partly in section, of a wear lining according to the invention in the form it has after manufacture, FIG. 3 is an enlarged view of the section shown in FIG. 2, FIG. 4 shows schematically a section of a pump housing of a dredger pump of centrifugal type provided with a wear lining according to the invention, FIG. 5 shows a section substantially along the line V—V in FIG. 4 and FIG. 6 shows a section similar to that in FIG. 5 but through a somewhat modified embodiment of the lining.

The wear lining according to the present invention comprises a support plate 1 of a metal plate, which can be bent, e.g. a steel plate or a plate of corrosion-proof material, e.g. stainless steel, and a layer 2 of vulcanized rubber attached, preferably vulcanized to this and having a thickness substantially greater than that of the support plate. This rubber layer 2 has a wear surface 3 and inside this at least one layer of pins 4 of steel or a corresponding material parallelly spaced and completely embedded in the rubber, which are oriented so that they extend substantially perpendicularly to the direction of current at a lining mounted in a pump housing, i.e. lie in radial planes parallel to the shaft of the pump wheel. The distance between the pins 4 should be at least equal to half the thickness of the pins and preferably equal to or somewhat greater than the thickness of the pins, as shown in FIG. 3. Moreover, the pins may have a round cross-sectional shape, as shown in the drawings, but an oval and another cross sectional shape is not excluded but within the scope of this invention. At more than one layer of pins 4 the pins in the different layers should be displaced relative to each other, as shown in FIG. 3, and the distance between the layers of pins is preferably less than the distance between two pins 4 in the same layer, the distance betwen the pin layers not necessarily being the same but possibly reciprocally different, which also applied to the thickness of the pins and their cross-sectional shape in the different layers. At several layers of pins 4 embedded in the rubber the layer being closest to the wear surface 3 should be at a distance from this which is less than half the thickness of the rubber layer, and only at a layer of pins 4 embedded in the rubber layer 2 this layer should be located more closely to the wear surface 3 than the support plate 1, to which the rubber layer is fixed.

According to the invention the pins 4 in each layer should be reciprocally parallelly arranged and, moreover, each pin 4 embedded in the rubber layer should be parallel at least to a normal plane extending perpendicular to the main longitudinal direction of the lining, and such a plane is marked with a line 5 in FIGS. 1 and 3. In this way, and because the pins 4 are arranged in spaced relationship to each other and not reciprocally connected in another way than through the rubber material the wear lining consisting of rubber according to the invention can be manufactured completely plane and in big lengths, and then, e.g. at the place of their use, be shaped as intended by bending in a conventional bending machine provided with e.g. three rolls.

The manufacture of wear linings according to this invention can be carried out in such a way that the rubber layer 2 is completely built up to the intended thickness and form on the wear surface 3 by applying layers of the rubber material directly on the support plate 1, which is then completely planarly extended, under simultaneous placing of the pins 4 in layers at the intended reciprocal distance and perpendicularly to the longitudinal direction of the support plate, i.e. so that the pins 4 in each wear lining mounted in a pump will be in a radial plane parallel to the pump wheel shaft 6 (see FIG. 5), in which plane the different layers of pins 4 need not be parallel to each other or to the wear surface 3 but should extend symmetrically on both sides of the intermediate plane of the lining marked with a line 7 in FIG. 5. As is shown in FIGS. 5 and 6 the wearing sleeve 3 can be designed as plain or curved, the layer of pins 4 closest to the wearing surface in the latter case being given the same curved shape as the wearing surface 3 or a flatter one.

After building up the rubber layer 2 with the layer of pins 4 placed therein vulcanization of the rubber takes place and the rubber layer is connected to the support plate 1 and the pins 4 with the rubber by vulcanization in an almost unseparable way. As is shown in FIG. 3 the edges of the support plate can be covered by a relatively thin layer 8 of the rubber, when applying the rubber thereon.

Even if the wear lining of the present invention should be used as a peripheral wear lining in a pump housing of a centrifugal pump or the like it can be manufactured in a plain form and be given the helical form corresponding to the pump housing or the shell by bending on the place of its mounting. This does not only simplify and cheapen the manufacture and the transport (requires less space in a plain form) but also the mounting of the lining in the pump housing, which, as shown in FIGS. 4 and 5, may comprise a wall 9 defining the shell and extending in the form of a spiral as well as two side walls 10 and 11, one of said side walls being detachable. The shell ends in known manner in an outlet 12 with a lining 13 and a nose section 14 at the sharp transition between the shell and the outlet. The nose section 14 shows a support surface 15, like the lining 13 of the outlet at 16.

For lining this pump housing with a wear lining according to the invention the wear lining manufactured and delivered in a plain state is first bent in a conventional bending machine e.g. provided with three bending rolls, to a helical shape somewhat bigger than the peripheral wall of the pump housing designated by 9, and then the lining thus bent is introduced into the pump housing, one of its end surfaces being moved towards the support surface 15 of the nose section, and thereafter the lining is pressed to the peripheral wall 9 and clamped to the end surface 16 of the lining 13 of the outlet. By internal tension the lining thus bent tends to spring against the peripheral surface 9 of the shell and is, in this way, retained inside the pump housing without any extra attaching means than the attachment created by the lateral lining of the pump housing designated by 17 in FIGS. 5 and 6, which may be of any known type and attached to the lateral walls 10 and 11 of the pump housing. As to the embodiment shown in FIG. 6 the bending roll or rolls acting against the rubber surface should have a profile at least corresponding to the cross sectional profile of the wear surface to distribute the forces arising in bending.

The bending of the wear lining according to the present invention to the intended curved shape after manufacture thereof in a plane shape will provide the advantage that a bias is in any case imparted to the rubber closest to the wear surface 3 by the compression arising at bending of the wear lining, which bias increases the wear resistance of the rubber, especially to cutting. The wear lining according to the invention can also be shaped with advantage in sections 18, as shown in FIG. 4, and in that case also each joint 19 between two sections of the wear lining will be very tight and durable thanks to the compression of the rubber in the ends of the sections of the wear lining facing each other when pressing these ends against each other until the ends of the support plates of the sections will make contact with each other. After bending each section of wear lining to its intended curved shape the ends of the sections will be so to speak undercut relative to a radial plane from the bending centre.

This invention is not restricted to what is described above and shown in the drawings, but can be changed, modified and supplemented in several different manners within the scope of the inventive idea defined in the claims. Even if the wear lining according to this invention has been described above as a peripheral wear lining for pumps it can of course be used everywhere where wavy or cylindrical wear linings are used, e.g. in mills and different kinds of drums.

What we claim is:

1. A method of producing a curved wear lining comprising forming a planar assembly which includes a layer of wear rubber attached to a flat bendable support plate and a plurality of parallel, spaced-apart metal pins embedded in the rubber layer and arranged parallel to the support plate, and curing by bending the assembly to place the layer of rubber in compression with the compression increasing from the support plate toward the face of the layer remote from the support plate and to orient the pins in radial planes extending from the center of curvature.

2. A method as in claim 1 wherein the bending is carried out simultaneously with attaching the layer of wear rubber to the plate.

* * * * *